United States Patent [19]

Gundlach et al.

[11] 3,960,444

[45] June 1, 1976

[54] ELECTROPHOTOGRAPHIC PRINTING MACHINE

[75] Inventors: Robert W. Gundlach, Victor; Charles A. Whited; Thomas W. Pike, both of Rochester, all of N.Y.

[73] Assignee: Xerox Corporation, Stamford, Conn.

[22] Filed: Aug. 14, 1974

[21] Appl. No.: 497,547

[52] U.S. Cl. ..... 355/3 DD; 118/637; 96/1.3

[51] Int. Cl.[2] ..... G03G 15/09; G03G 15/00

[58] Field of Search ..... 355/3 R, 3 DD, 71, 17; 96/1.3; 118/637

[56] References Cited

UNITED STATES PATENTS

| | | | |
|---|---|---|---|
| 3,212,889 | 10/1965 | Gundlach et al. | 96/1.4 |
| 3,815,988 | 6/1974 | McVeigh et al. | 355/3 DD |
| 3,872,825 | 3/1975 | Davidson | 355/3 DD X |

*Primary Examiner*—Robert P. Greiner
*Attorney, Agent, or Firm*—H. Fleischer; J. J. Ralabate; C. A. Green

[57] ABSTRACT

An electrophotographic printing machine and method of use therefor in which a plurality of light images of the same original document are formed. Each of the light images is of a different predetermined magnitude and irradiates a charged photoconductive member to record a plurality of electrostatic latent images thereof. The electrostatic latent images are developed with developer mixes having differing predetermined concentrations of toner particles therein. These developed powder images are transferred, in superimposed registration with one another, onto a common sheet of support material forming a high quality reproduction of the original document.

22 Claims, 10 Drawing Figures

ELECTROPHOTOGRAPHIC PRINTING MACHINE

This invention relates generally to electrophotographic printing, and more particularly concerns an improved printing technique for producing high quality continuous tone reproductions.

The process of electrophotographic printing comprises exposing a charged photoconductive member to a light image of an original document. The irradiated areas of the photoconductive surface are discharged to record thereon an electrostatic latent image corresponding to the original document. A development system then moves a developer mix of carrier granules and toner particles into contact with the photoconductive surface. Toner particles are attracted electrostatically to the latent image from the carrier granules to form a toner powder image on the latent image. This toner powder image is then transferred to a sheet of support material. After the toner powder image has been transferred to the sheet of support material, the sheet of support material advances to a fuser which permanently affixes the toner powder image thereto.

In electrophotographic printing of this type, it has been feasible to produce high quality line copies. With the introduction of development electrodes and magnetic brush development system, images containing solid areas of various shades have also been reproduced on the copies successfully. The introduction of screening techniques have further extended the range of electrophotographic printing to half tone images.

In electrophotography, it is extremely difficult to create the full latitude of continuous tone contrast that is possible in conventional photography. It would be highly desirable to be capable of forming high quality photographic reproductions from continuous tone original documents. Hereinbefore, electrophotographic printing has reproduced originals wherein silhouettes or very high contrast images are depicted on the copy. However, it has not been feasible to create high quality copies of original documents having faithful contrast differences for both highlights and shadows. Techniques which accomplish this require complex equipment and highly sensitive controls, such as screening, that must be continually monitored during the printing process.

The technique of increasing the dynamic range or the brightness acceptance range, of an electrophotographic printing machine is frequently referred to as extended range electrophotographic printing. One approach to extended range electrophotographic printing is described in U.S. Pat. No. 3,212,889 issued to Gundlach et al., in 1965. As described in the foregoing patent, an electrophotographic reproduction process is utilized in which a photoconductive plate is charged, exposed to an image with a preselected magnitude of exposure, developed and transferred to a support sheet. Residual toner particles are cleaned from the photoconductive plate and the photoconductive plate is then re-sensitized and re-exposed to the same image with a different magnitude of exposure. The second image is developed and transferred in superimposed registration with the first image onto the common copy sheet. The foregoing process may be repeated a plurality of times to form successive toner powder images for different magnitudes of exposure. In this techique, the same developer mix is employed to develop each latent image recorded on the photoconductive plate.

It is the primary object of the present invention to improve electrophotographic printing machines so as to further extend the range thereof and achieve high quality continuous tone reproductions therefrom.

SUMMARY OF THE INVENTION

Briefly stated, and in accordance with the present invention, there is provided a method of electrophotographic printing.

Pursuant to the present invention, this method includes sensitizing a photoconductive member and exposing the sensitized photoconductive member to a light image of an original document. The light image is of a predetermined magnitude to record an electrostatic length image thereon. A developer mix of carrier granules and toner particles develops the latent image. The concentration of toner particles within the developer mix is of a preselected magnitude. This developed image mix is of a preselected magnitude. This developed image is then transferred to a sheet of support material. The foregoing steps of sensitizing, exposing, developing and transferring are repeated a plurality of cycles. Each step of exposure is with a light image of different magnitude. Similarly, each step of developing the latent image formed by light images of a different magnitudes is with developer mixes having toner particles of different preselected concentrations within the developer mix. These developed images are transferred to the sheet of support material in superimposed registration with one another.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment and method of use therefore, it will be understood that it is not intended to limit the invention to that embodiment or method of use. On the contrary, it is intended to cover all alternatives, modifications and equivalents as may be included within the spirit and scope of the invention as defined by the appended claims.

DETAILED DESCRIPTION

Figure 1:
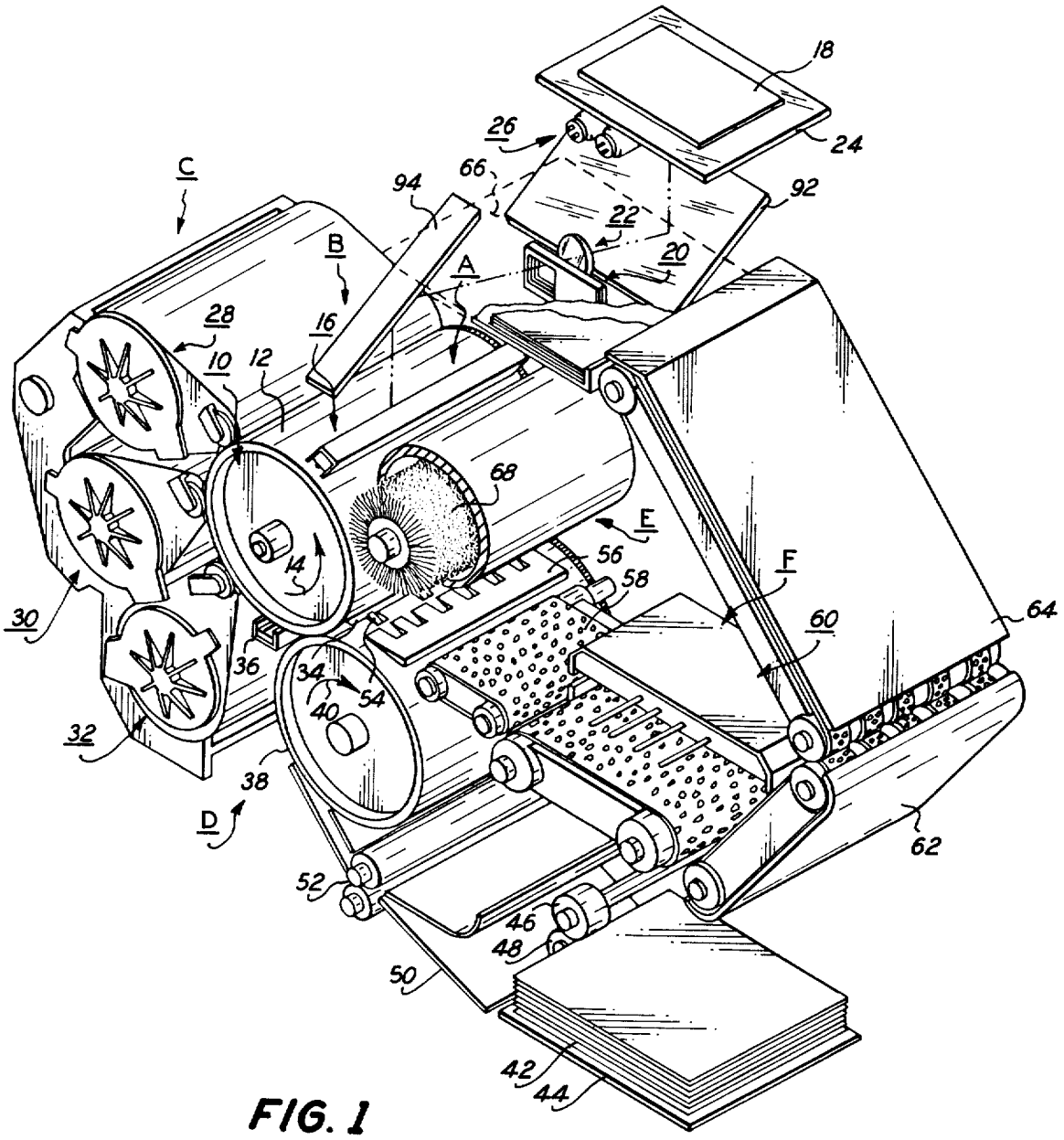
FIG. 1 is a schematic perspective view of an electrophotographic printing machine incorporating the features of the present invention therein.

An electrophotographic printing machine adapted to form photographic quality copies from continuous tone original documents is depicted in FIG. 1. The foregoing printing machine will be described in detail to provide an illustrative example of the printing process employed in the present invention. Continued reference will be had throughout this description to the drawings. In the drawings, like reference numerals have been used throughout to designate like elements.

Initially, the overall process for producing copies will be described for reference to FIG. 1. Thereafter, the detailed structural configuration of the various subassemblies utilized in the FIG. 1 printing machine will be discussed with reference to FIGS. 2 through 9, inclusive. Finally, the results achieved by the apparatus of the present invention will be described with reference to the graph shown in FIG. 10.

Although the electrophotographic printing machine of the present invention is particularly well adapted for producing continuous tone black and white copies, it should become evident from the following discussion that it is equally well suited for producing all varieties of copies including full color copies, and is not necessarily limited to the particular materials and apparatus described herein.

As depicted in FIG. 1, the electrophotographic printing machine employs a photoconductive member having a drum 10 mounted rotatably within the machine frame (not shown). Photoconductive surface 12 is secured to and entrained about the exterior circumferential surface of drum 10. One type of suitable photoconductive material is formed from a selenium alloy and is described in U.S. Pat. No. 3,655,377 issued to Sechak in 1972, the disclosure of which is hereby incorporated into the present application. A series of processing stations are disposed such that as drum 10 rotates in the direction on arrow 14, it passes sequentially therethrough. Drum 10 is driven at a predetermined speed relative to the other machine operating mechanisms from a common drive motor (not shown). A timing disc mounted in the region of one end of the shaft of drum 10 cooperates with the machine logic to synchronize the various operations with the rotation of drum 10. In this manner, the proper sequence of events is produced at the respective processing stations. Turning now to the various processing stations, drum 10 initially rotates photoconductive surface 12 through charging station A.

At charging station A, a corona generating device, indicated generally at 16, extends longitudinally in a generally transverse direction across photoconductive surface 12. Corona generating device 16 will be described hereinafter, in greater detail, with reference to FIG. 2. However, in general, corona generating device 16 is adapted to spray ions onto photoconductive surface 12 producing a relatively high, substantially uniform charge thereon.

As various areas of photoconductive surface 12 are charged to a substantially uniform potential, drum 10 rotates to move these areas to exposure station B. At exposure station B, a filtered light image of original document 18 is projected onto charged photoconductive surface 12. A plurality of neutral density filters are disposed in filter mechanism 20. A different neutral density filter is interposed into the optical light path so as to form differing predetermined magnitude light images. Exposure station B includes a moving lens system, generally designated by the reference numeral 22. An original document 18, such as a sheet of paper, a book or the like is placed face down upon transparent viewing platen 24. As shown in FIG. 1, lamps 26 are adapted to move in a timed relation with lens 22 and filter mechanism 20 to scan successive incremental areas of original document 18 disposed upon platen 24. In this way, a flowing light image of original document 18 is projected onto photoconductive surface 12. Exposure system B will be described hereinafter in greater detail with reference to FIG. 3.

After the electrostatic latent image is recorded on photoconductive surface 12, drum 10 rotates to development station C. At development station C, three individual developer units, generally designated by the reference numbers 28, 30 and 32, respectively, are arranged to render visible the electrostatic latent image recorded on photoconductive surface 12. Preferably, the developer units are all of the type generally referred to in the art as "magnetic brush developer units". A typical magnetic brush system employs a magnetizable developer mix which includes carrier granules and toner particles. Generally, the toner particles are heat settable. In operation, the developer mix is continually brought through a directional flux field to form a brush thereof. The electrostatic latent image recorded on photoconductive surface 12 is brought into contact with the brush of developer mix. Toner particles are attracted from the developer mix to the latent image. Each of the developer units contain a developer mix which has different concentrations of toner particles therein. The concentration of toner particles within each of the respective developer mixes is controlled by the regulating apparatus depicted in FIG. 9. The development system employed in the FIG. 1 printing machine will be discussed, in greater detail, with reference to FIGS. 4 and 5.

Drum 10 is next rotated to transfer station D where the powder image adhering electrostatically to photoconductive surface 12 is transferred to a sheet of final support material 34. Support material 34 may be a plain sheet of paper or a sheet of thermoplastic material, amongst others. Transfer station D includes corona generating means, indicated generally at 36, and a transfer member, designated generally by reference numeral 38. Corona generator 36 is excited with a direct current biasing alternating current that is arranged to precondition the toner powder image adhering electrostatically to photoconductive surface 12. In this manner, the preconditioned toner powder image will more readily be transferred from the electrostatic latent image recorded on photoconductive surface 12 to support material 34 by transfer member 38. Transfer member 38 is a roll adapted to recirculate support material 34 and is electrically biased to a potential of sufficient magnitude and polarity to attract electrostatically preconditioned toner particles from the latent image recorded on photoconductive surface 12 to support material 34. Transfer roll 38 rotates in synchronism with drum 10 to maintain the electrostatic latent image recorded on photoconductive surface 12 in registration with support material 34 secured releasably thereto. Inasmuch as support material 34 is secured releasably on transfer member 38 for movement in a recirculating path therewith, successive toner powder images may be transferred thereto in superimposed registration with one another. In this case, transfer roll 38 rotates, in the direction of arrow 40, at substantially the same angular velocity as drum 10. Corona generator 36 and transfer member 38 will be described hereinafter in greater detail with reference to FIG. 6.

Gripper fingers 54 secure support material 34 releasably on transfer roll 38 for movement in a recirculating path therewith. After a plurality of toner powder image (in this case three) have been transferred to support material 34, gripper fingers 54 space support material 34 from transfer roll 38. Stripper bar 56 is then interposed therebetween to separate support material 34 from transfer roll 38.

After support material 34 is removed from transfer roll 38, endless belt conveyor 58 advances it to fixing station E. At fixing station E, a fuser, indicated generally at 60, permanently affixes the transferred powder images to support material 34. Fuser 60 will be described hereinafter, in greater detail, with reference to FIGS. 7 and 8. After the fusing process, support material 34 is advanced by endless belt conveyors 62 and 64 to catch tray 66 permitting subsequent removal therefrom by the machine operator.

Although a preponderance of the toner particles are transferred to support material 34, invariably some residual toner particles remain on photoconductive surface 12 after the transfer of the toner powder image therefrom. Residual toner particles are removed from photoconductive surface 12 as it passes through cleaning station F. At cleaning station F, the residual toner particles are initially brought under the influence of a cleaning corona generating device (not shown) adapted to neutralize the electrostatic charge remaining on the residual toner particles and photoconductive surface 12. The neutralized toner particles are then cleaned from photoconductive surface 12 by a rotatably mounted fibrous brush 68 in contact therewith. A suitable brush cleaning device is described in U.S. Pat. No. 3,590,412 issued to Gerbasi in 1971.

The foregoing sequence of events is repeated for three cycles. In each of the cycles a different magnitude neutral density filter is employed so as to create different magnitude light images. In addition, different developer mixes are employed to develop the electrostatic latent images recorded on the photoconductive surface. The developer mixes all contain different concentrations of toner particles therein.

It is believed that the foregoing description is sufficient for purposes of the present application to depict the general operation of the electrophotographic printing machine of the present invention. Hereinafter, each of the specific sub-assemblies employed in the electrophotographic printing machine of FIG. 1 will be described in greater detail.

Figure 2:
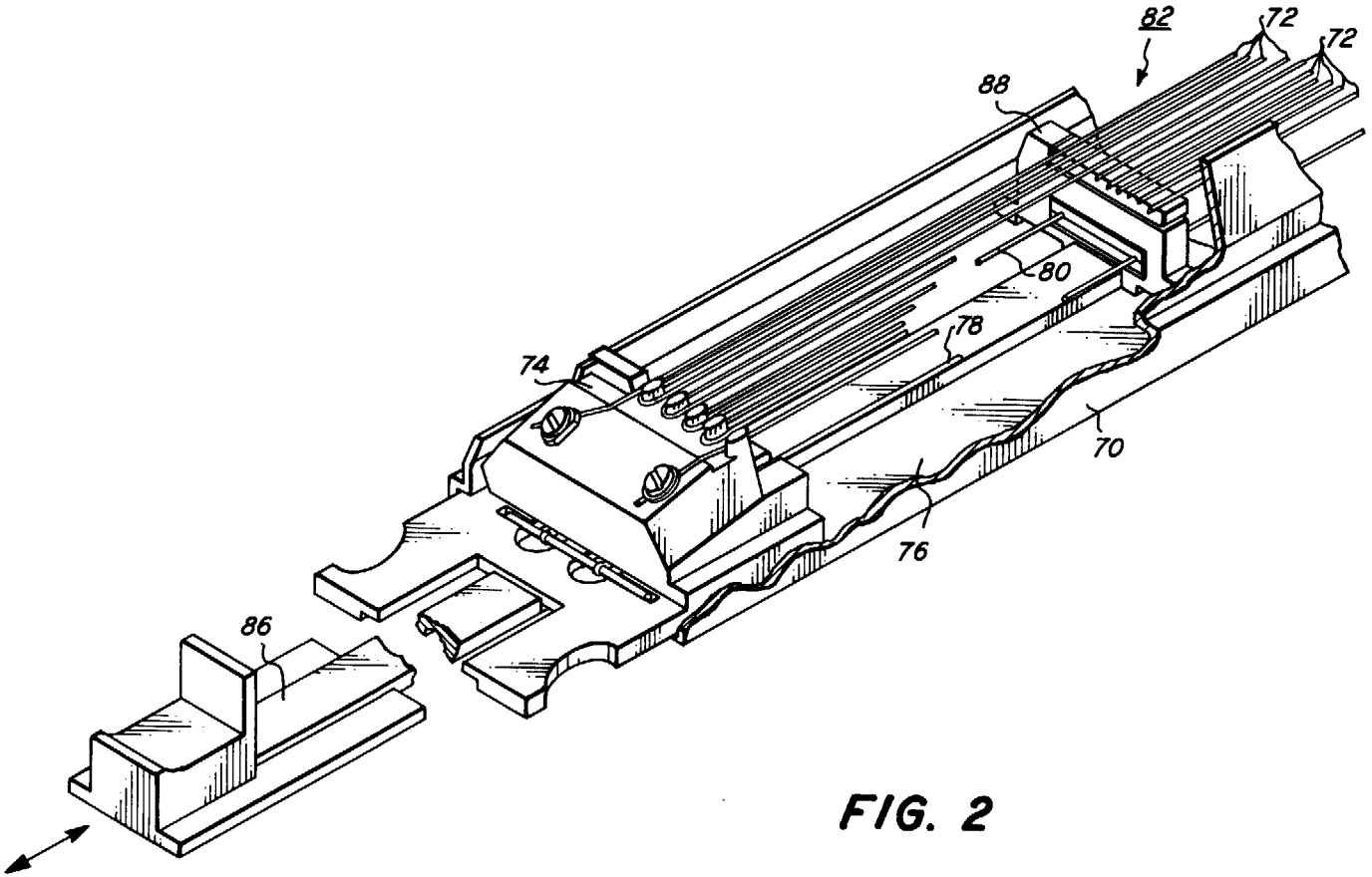
FIG. 2 is a perspective view of a corona generating apparatus employed in the FIG. 1 printing machine.

FIG. 2 describes corona generating device 16 in detail. Corona generating device 16 includes an elongated conductive shield 70 defining an open ended chamber opposed from and closely spaced to photoconductive surface 12. Shield 70 is a U-shaped housing and, preferably, is made from an aluminum extrusion. A plurality of substantially parallel, spaced fine conductive wires 72 (in this case 10) extend in a longitudinal direction from one end of shield 70 to the other end thereof and across about three-quarters of the open end of the chamber therein. An insulating plate 74 is affixed permanently to both ends of shield 70 to a suitable means (not shown) e.g. fasteners. Interposed between grid wires 72 and back wall 76 of shield 70 is a pair of coronode wires 78 and 80, respectively. Both grid wires 72 and coronode wires 78 and 80, respectively, are, preferably, made from a conductive material, as for example, platinum. Insulating plate 74 is, preferably, made from a dielectric material such as a glass alkyd, polycarbonate plastic, polymethylmethacrylate plastic, or the like. As shown in FIG. 2, coronode wire 80 is positioned in the portion of the chamber of shield 70 that is not covered by grid wires 72, i.e. grid wires 72 do not extend over this portion of the open end of shield 70. As hereinbefore mentioned, grid wires 72 extend only across about three-quarters of the open end of shield 70. This permits rapid and roughly controlled charging of photoconductive surface in the lead section of the portion of shield 70 not covered by grid wires 72. Slow and well controlled charging is obtained over the trailing section or portion of the shield 70 covered by grid wires 72. A high voltage source (not shown) excites coronode wires 78 and 80 to a voltage preferably ranging from about 6000 volts to about 8000 volts and the coronode current ranges from about 200 to about 500 micro amps. A low voltage source (not shown) excites grid wires 72 to preferably about 800 volts.

In order to reduce the sensitivity of corona generating apparatus 16 to contamination, deposits of toner particles and dust collected on coronode wires 78 and 80, respectively, and grid wires 72 are removed therefrom by wiper member 82. Wiper member 82, is, preferably, formed of a slightly abrasive material such as felt, foam or expanded polyester. Moving means or a support carriage, generally indicated at 84, reciprocate wiper member 82 along coronode wires 78 and 80 as well as along the surface of grid wires 72 opposed therefrom. Support carriage 84 includes an elongated rod 86 attached to support 88. Rod 86 extends through insulating plate 74. Preferably, rod 86 extends longitudinally through the center of shield 70. In this manner, an operator may grasp rod 86 to reciprocate wiper member 82 in a longitudinal direction. This causes wiper 82 to remove dust particles from coronode wires 78 and 80 and grid wires 72. Corona generating device 16 is described in greater detail in co-pending application Ser. No. 307,250 filed in 1972, the disclosure of which is hereby incorporated into the present application.

Figure 3:
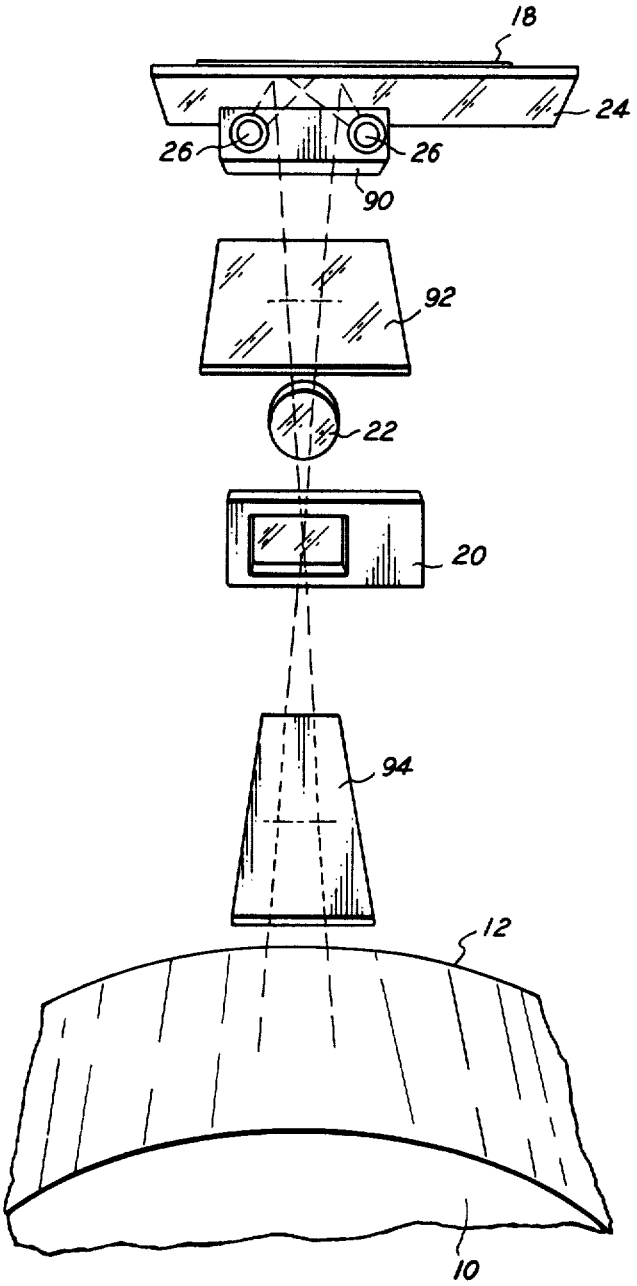
FIG. 3 is a schematic illustration of the optical system of the FIG. 1 printing machine.

Turning now to FIG. 3, exposure station B is described therein in greater detail. Lamp carriage 90 supports a pair of light sources or lamps 26 thereon. Lamp carriage 90 is arranged to traverse platen 24 illuminating incremental areas of original document 18 disposed thereon. A cable pulley system operatively associated with the drive (not shown) moves lamp carriage 90 across platen 24. Another cable pulley system acts to move lens 22 at a correlated speed therewith. Filter assembly 20 is mounted on a suitable bracket on lens 22 to move therewith. Lamps 26, lens 22 and filter 20 scan original document to create a flowing light image thereof moving synchronously with photoconductive surface 12 of drum 10. Upon reaching the end of the scan path, lamps 26, lens 22 and filter 20 are resiliently urged to return to their initial positions for the start of the next cycle. Thus, it should be clear that the movement of lens 22, filter 20 and lamps 26 is correlated with the speed of rotation of drum 10 exposing charged photoconductive surface 12 to a light image of the original document 18. Greater details regarding the drive system of the optical system described in FIG. 3 are contained in U.S. Pat. No.

3,062,109 issued to Mayo et al, in 1962, the disclosure of which is hereby incorporated into the present application.

With continued reference to FIG. 3, mirror 92 reflects light rays reflected from original document 18 through lens 22. After passing through lens 22, the light rays are transmitted through filter 20. Thereafter, the light rays are reflected from a second mirror 94 onto photoconductive surface 12 to selectively dissipate the charge thereon in the irradiated areas forming an electrostatic latent image.

Preferably, lens 22 is a six element, split dagor type of lens having front and back compound lens components with a centrally located diaphragm therebetween. The lens system forms high quality images with a field angle of 31° and a speed of F/4.5 at a 1:1 magnification. The front lens component has three lens elements including, in the following order, a first lens element of positive power, a second lens element of negative power cemented to the first element, and a third lens element of positive power disposed between the second lens element and diaphragm. The back lens component also has three similar components positioned so that lens 22 is symmetrical. Specifically, the first lens element in the front component is a double convex lens, the second element a double concave lens, and the third element, a convex-concave element. For greater details regarding lens 22, reference is made to U.S. Pat. No. 3,592,531 issued to McCrobie in 1971, the disclosure of which is hereby incorporated into the present application.

Filter 20 includes a housing which is mounted on lens 22 by a suitable bracket and moves therewith during the scanning process as a single unit. The housing of filter 20 has a window which is positioned relative to lens 22 to allow the light reflected from original document 18 on platen 24 to pass therethrough. The bottom and top walls of the housing member include a plurality of tracks extending the entire width thereof. Each track is adapted to carry a neutral density filter and a filter frame in a manner to allow movement of the neutral filter from an inoperative position to an operative position interposed in the window of the housing allowing light rays to pass therethrough. Individual filters are mounted in a frame and made of any suitable filter material such as a coated glass. The number of filters employed in the electrophotographic printing machine of FIG. 1 is three. One of the neutral density filters has a value of 0.95, a second value of 0.55 and a third a value of 0.02. The neutral density filters are locked into position out of line of the housing window by means of a stop pin which extends up through an opening in the bottom of the housing into the respective track of each filter. A solenoid arm, in association with the stop pin, retains the filters in the inoperative position. A selected neutral density filter is inserted into the optical path of the housing window by energizing of the appropriate solenoid. By activating the selected solenoid, the respective stop pin is moved downward away from the path of the appropriate neutral density filter, thereby allowing a spring cooperating with the neutral density filter to advance the filter into the optical path of the housing window. When the neutral density filter is moved into an operative position in the housing window, the filter will remain during the entire scanning of the original document. As previously indicated, lens 22 and filter 20 are adapted to return to the starting position upon the completion of scanning of the original document 18. During the return of this system to the initial position, the first neutral density filter is removed from the operative position and a second neutral density filter is inserted therein. As hereinbefore indicated, filter mechanism 20 includes three neutral density filters. Each filter is associated with a respective developer unit and the associate developer mix therein having a preselected toner particle concentration. Thus, the 0.95 neutral density filter is associated with developer unit 28, the 0.55 neutral density filter is associated with developer unit 30, and 0.2 neutral density filter is associated with developer unit 32. During the first cycle the 0.95 neutral density filter is interposed into the optical path and developer unit 28 is actuated to develop the electrostatic latent image formed thereby. During the next successive cycle, the 0.55 neutral density filter is interposed into the optical light path and developer unit 30 deposits toner particles on the electrostatic latent image formed thereby. Finally, on the third cycle, the 0.2 neutral density filter is interposed into the optical light path and developer unit 30 deposits toner particles on the electrostatic latent image recorded on the photoconductive surface. The detailed structural configuration of filter mechanicm 20 is described in U.S. Pat. No. 3,775,006 issued to Hartman et al, in 1973, the relevant portions of this disclosure being hereby incorporated into the present application.

Figure 4:
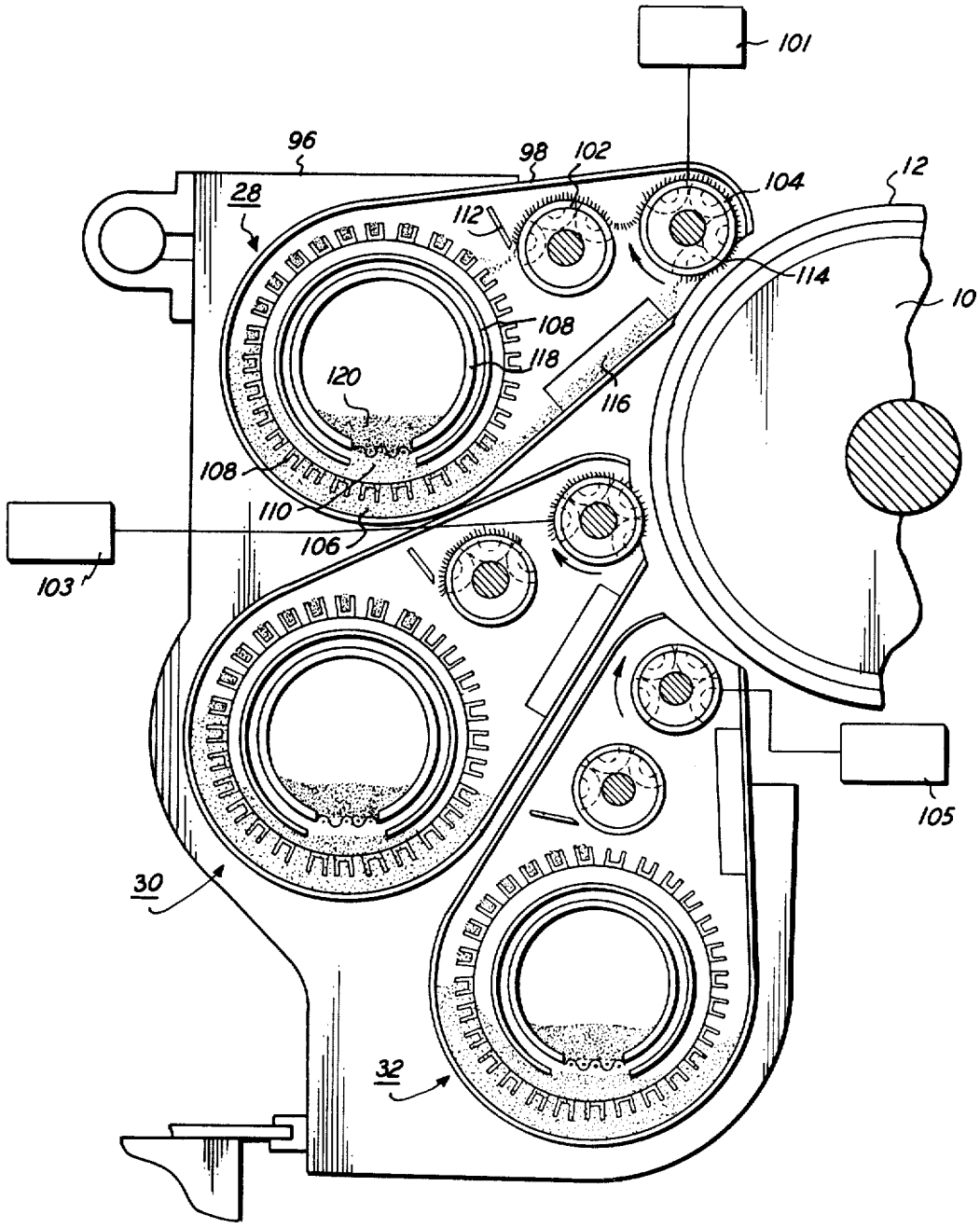
FIG. 4 is a sectional elevational view of the development system utilized in the FIG. 1 printing machine.
Figure 5:
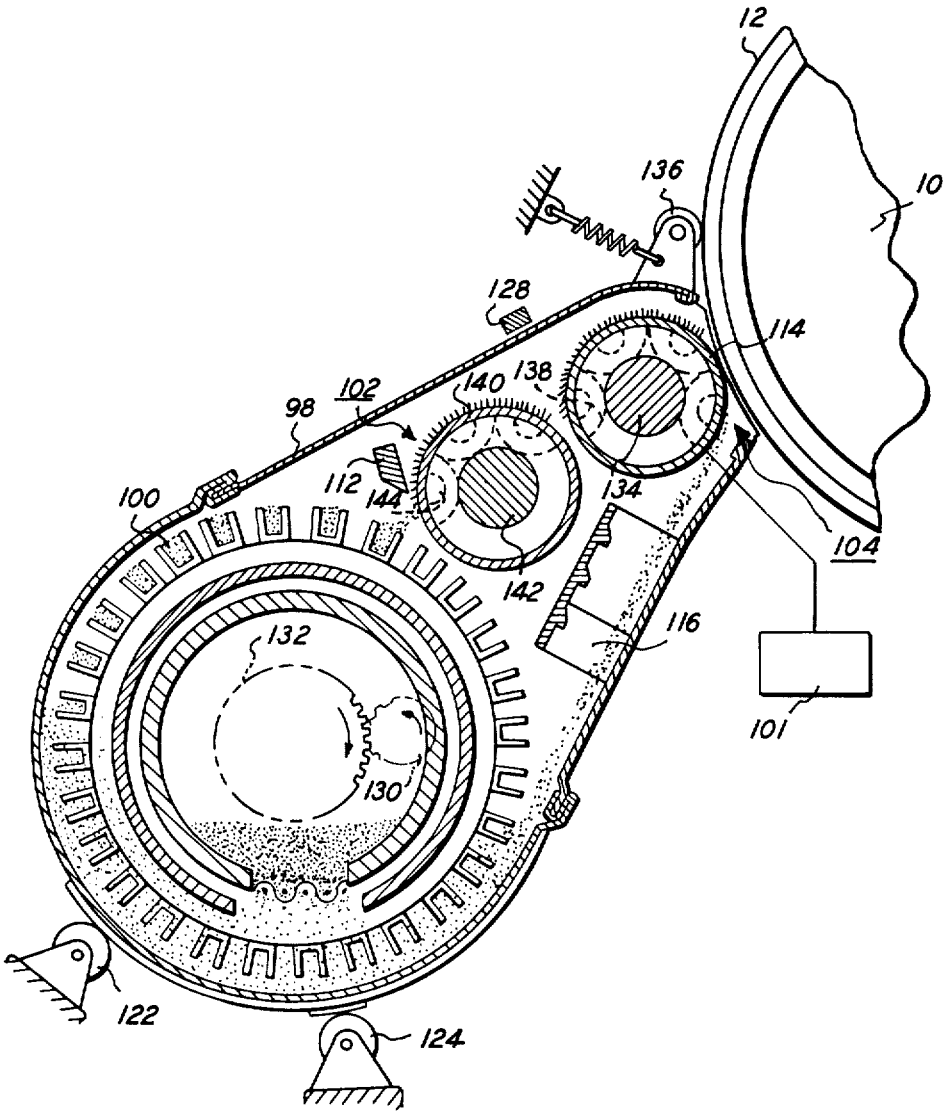
FIG. 5 is a fragmentary, sectional elevational view depicting, in detail, one of the developer units shown in the FIG. 4 development system.

Referring now to FIGS. 4 and 5, the development system of the FIG. 1 electrophotographic printing machine will be described in detail. As shown in FIG. 4, frame 96 supports three toner depositing means or developer units 28, 30 and 32, respectively. These developer units are depicted in an elevational sectional view to illustrate more clearly the various components included therein. Only developer unit 28 will be described in detail as developer units 30 and 32 are nearly identical thereto. The distinction between each of the developer units is the concentration of toner particles within the developer mix and minor geometrical differences due to the mounting arrangement. Developer unit 28 may have a toner particle concentration of 1.95%, unit 30 a toner particle concentration of 2.22%, and unit 32 a toner particle concentration of 2.59%. For purposes of explanation, developer unit 28 will hereinafter be described in detail.

The principle components of developer unit 28 are developer housing 98, conveyor means or paddle wheel 100, transport means or roll 102, and developer means or roll 104. Paddle wheel 100 is a cylindrical member with buckets or scoops around the periphery thereof and rotates to elevate developer mix 106 from the lower region of housing 98 to the upper region thereof. When developer mix 106 reaches the upper region of housing 98, it is lifted from the paddle wheel buckets to transport roll 102. Alternate buckets of paddle wheel 100 have apertures in the root diameter so that the developer mix of those areas is not carried to transport roll 102, but, in lieu thereof, falls back to the lower region of developer housing 98. As the developer mix falls back to the lower region of developer housing 98, it cascades over shroud 108 which is of a tubular configuration with aperture 110 in the lower region thereof. Developer mix 106 is recirculated in this manner so that the carrier granules are continually agitated to mix with fresh toner particles. This generates a strong triboelectric charge between the carrier granules and toner particles. As developer mix 106, in the paddle wheel buckets, approaches transport roll 102, the magnetic field produced by the fixed magnets therein attract developer mix 106. Transport roll 102 moves developer mix 106 in an upwardly direction by the frictional force exerted between the roll surface and developer mix. A surplus of developer mix is furnished, metering blade 112 being arranged to control the amount of developer mix carried over the top of transport roll 102. The surplus developer mix 106 is sheared from transport roll 102 and falls in a downwardly direction toward paddle wheel 100. As the surplus developer mix descends, it falls through the apertures of paddle wheel 100 in a downwardly direction to the lower region of developer housing 98. The developer mix, which passes metering blade 112, is carried over transport roll 102 to developer roll 104 and into development zone 114 located between photoconductive surface 12 and developer roll 104. The electrostatic latent image recorded on photoconductive surface 12 is developed by contacting moving developer mix 106. The charged areas of photoconductive surface 12 electrostatically attract toner particles from the carrier granules of developer mix 106. Upon passing from the development zone, the unused developer mix and denuded carrier granules enter a region relatively free from magnetic force and fall from developer roll 104 in a downwardly direction to the lower region of developer housing 98. As the unused developer mix and denuded carrier granules descend they pass through mixing baffle 116 which diverts the flow from the ends toward the center of developer housing 98 to provide mixing in this direction. Toner cartridge 118 is disposed in shroud 108 and oscillates periodically about the longitudinal axis thereof to dispense additional toner particles 120 into developer mix 106. The oscillation of toner cartridge 118 is controlled by the regulating system of FIG. 9 which will be described hereinafter in greater detail. A detailed description of toner cartridge 118 may be found in co-pending application Ser. No. 266,875 filed in 1972, the disclosure of which is hereby incorporated into the present application.

Referring now to FIG. 5, the operation of developer unit 28 will be discussed in detail. Developer housing 98 is pivoted about the center of paddle wheel 100 and is supported at the lower region of the exterior surface by roller 122 and 124 mounted rotatably in frame 96. Biasing means or spring 126 pivot developer housing 98 against stop 128. In this position developer roll 104 is in a non-operative position spaced from photoconductive surface 12. Operation begins when clutch gear 130 measures with gear 132 which is attached to a paddle wheel 100. As gear 132 and paddle wheel 100 start to rotate, a reaction torque is exerted against developer housing 98 due to the resistance to motion of the developer mix 106 which fills developer housing 98. This reaction torque causes housing 98 to rotate clockwise against the force of spring 126 until a stop, shown as a wheel 136, is positioned against drum 10. Rolls 102 and 104 are rotated in conjunction with paddle 100 by a gear train (not shown). When the latent image recorded on photoconductive drum 10 has passed development zone 114, development action is discontinued and the developer mix removed from contact with photoconductive surface 12. To achieve this, the drive motor is disconnected from gear 130 by de-energizing the clutch leaving gear 130 free to turn in either direction. Paddle wheel 100, developer roll 104 and transport roll 102 stop rotating, and developer housing 98 is pivoted clockwise by spring 126 until it engages stop 114 in its inoperative position. This completes the cycle.

In the preferred embodiment thereof, development means or roll 104, as best shown in FIG. 5, includes a non-magnetic tubular member 134, preferably made from an aluminum tube having an irregular or roughened exterior surface. Tubular member 134 is journaled for rotation by suitable means such as ball bearing mounts. A shaft 136, preferably made of steel is mounted within tubular member 134 and serves as a fixed mounting for the magnetic means 138. Magnetic means 138, includes preferably magnets of barium ferrite in the form of annular rings arranged with five poles on about a 284° arc about shaft 136.

Similarly, transport means or roll 102 includes a non-magnetic tubular member 140 also preferably made from an aluminum tube having an irregular or roughened exterior surface. Tubular member 140 is journaled for rotation by suitable means such as ball bearing mounts. A shaft 142, preferably made of steel is concentrically mounted within tubular member 40 and functions as a fixed mounting for magnetic means 144. Magnetic means 144, preferably, includes barium ferrite magnets in the form of annular rings arranged with four poles on about arc about shaft 142. Each to the developer units 28, 30 and 32, respectively, is actuated by the time disc (not shown) mounted on the shaft of drum 10. The timing disc is opaque with a plurality of spaced slots in the circumferential periphery thereof. This disc is interposed between an illuminating source and a photosensor to generate an electrical signal as each slot permits light rays to pass through the disc. The electrical signal, in association with the machine logic, actuates the appropriate developer unit. The development system heretofore discussed is disclosed in co-pending application Ser. No. 255,259 filed in 1972, the relevant portions of that disclosure being hereby incorporated into the present application.

With continued reference to FIG. 5, each of the developer units 28, 30 and 32, respectively, have their developer rolls electrically biased to a suitable electrical potential. In particular, developer roll of development unit 28 is connected to voltage source 103 (FIG. 4) which electrically biases to about 225 volts. Similarly, voltage source 103 electrically biases the developer roll of developer unit 30 to about 300 volts. Voltage source 105 (FIG. 4) electrically biases developer roll of developer unit 32 to about 425 volts.

Figure 6:
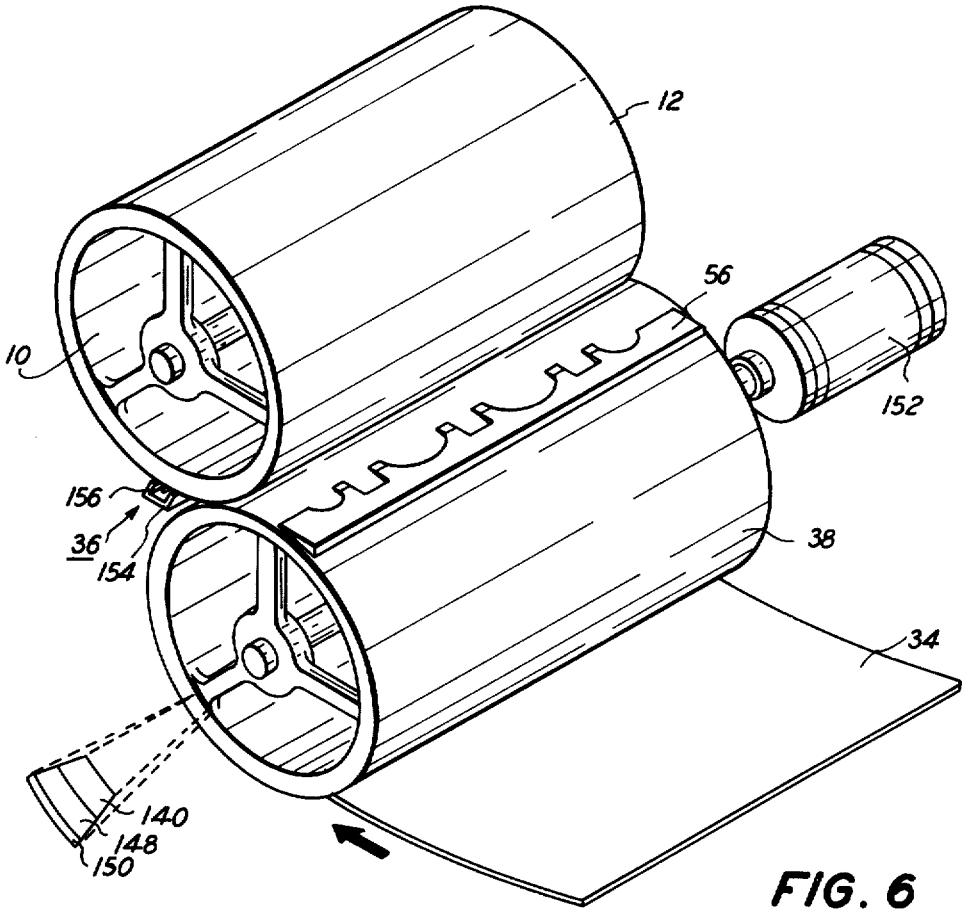
FIG. 6 is a schematic perspective view of the transfer system employed in the FIG. 1 printing machine.

Turning now to FIG. 6, the structural arrangement of transfer station D is described therein in detail. Transfer roll 38 includes an aluminum tube 146 preferably having a ¼ inch thick layer of urethane 148 cast thereabout. A polyurethane coating 150, preferably of about 1 mi. thick, is sprayed over the layer of urethane 148. Preferably, transfer roll 38 has a durometer hardness ranging from about 10 units to about 30 units on the Shore A scale. The resistivity of transfer roll 38, preferably, ranges from about $10^8$ to about $10^{11}$ ohms centimeters. A direct current bias voltage is applied by a suitable voltage source (not shown) to aluminum tube 146 by suitable means, such as a carbon brush and brass ring assembly (not shown). The transfer voltage may range from about 1500 to about 4500 volts. Transfer roll 38 is substantially the same diameter as drum 10 and is driven at substantially the same angular velocity. Contact between photoconductive surface 12 of drum 10 and transfer roll 38 with support material 34 interposed therebetween is preferably limited to a maximum of about 1.0 lbs. linear force. A flexible metal bellows 152 couples transfer roll 38 to drive system for drum 10 so as to permit the movement of transfer roll 38 relative to drum 10 while still maintaining transfer roll 38 in synchronous rotation with drum 10. Both of the foregoing members are driven from a common drive motor.

As shown in FIG. 6, corona generator 36 includes an elongated shield 154 made from a conductive material such as an aluminum extrusion. Elongated shield 154 is substantially U-shaped and may be grounded or, in lieu thereof, biased to a suitable electrical voltage. A discharge electrode 156 is mounted in the chamber or U-shaped shield 154. Discharge electrode 156 is, preferably, a platinum coronode wire extending longitudinally along the length of shield 154 which is excited to produce a flow of ions therefrom. The ion flow is adapted to pre-condition the toner particles deposited on the electrostatic latent image of photoconductive surface 12. In this way, the efficiency of transfer roll 38 is enhanced to attract the toner powder image more readily from the electrostatic latent image recorded on photoconductive surface 12. When the toner particles are so preconditioned, substantially the entire powder image is transferred from photoconductive surface 12 to the sheet of support material. Preferably, discharge electrode 156 is excited at about 110 micro amperes and at about 44 volts rms, the range being from about 80 micro amperes at about 3000 volts rms to about 200 micro amperes at about 500 volts rms. The alternating current output from coronode wire 156 to photoconductive surface 12 with the toner powder image thereon ranges from about 3 to about 5 micro amperes and is preferably about 4 micro amperes. The foregoing arrangment for transferring the toner powder image to the sheet of support material is described in co-pending application Ser. No. 335,968, filed in 1973, the disclosure of which is hereby incorporated into the present application.

Figure 8:
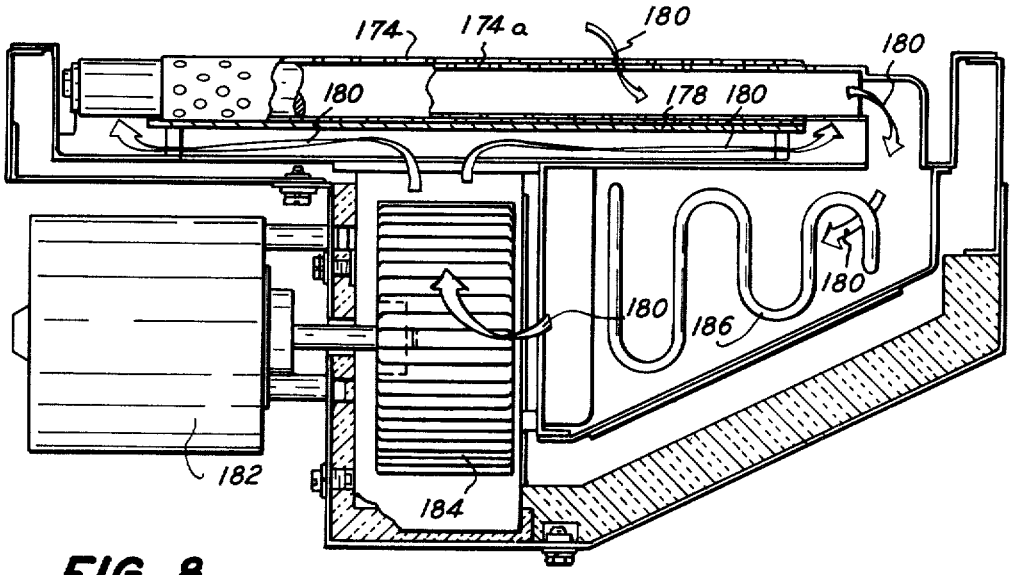
FIG. 8 is a sectional elevational view of the FIG. 7 fuser lower housings.
Figure 7:
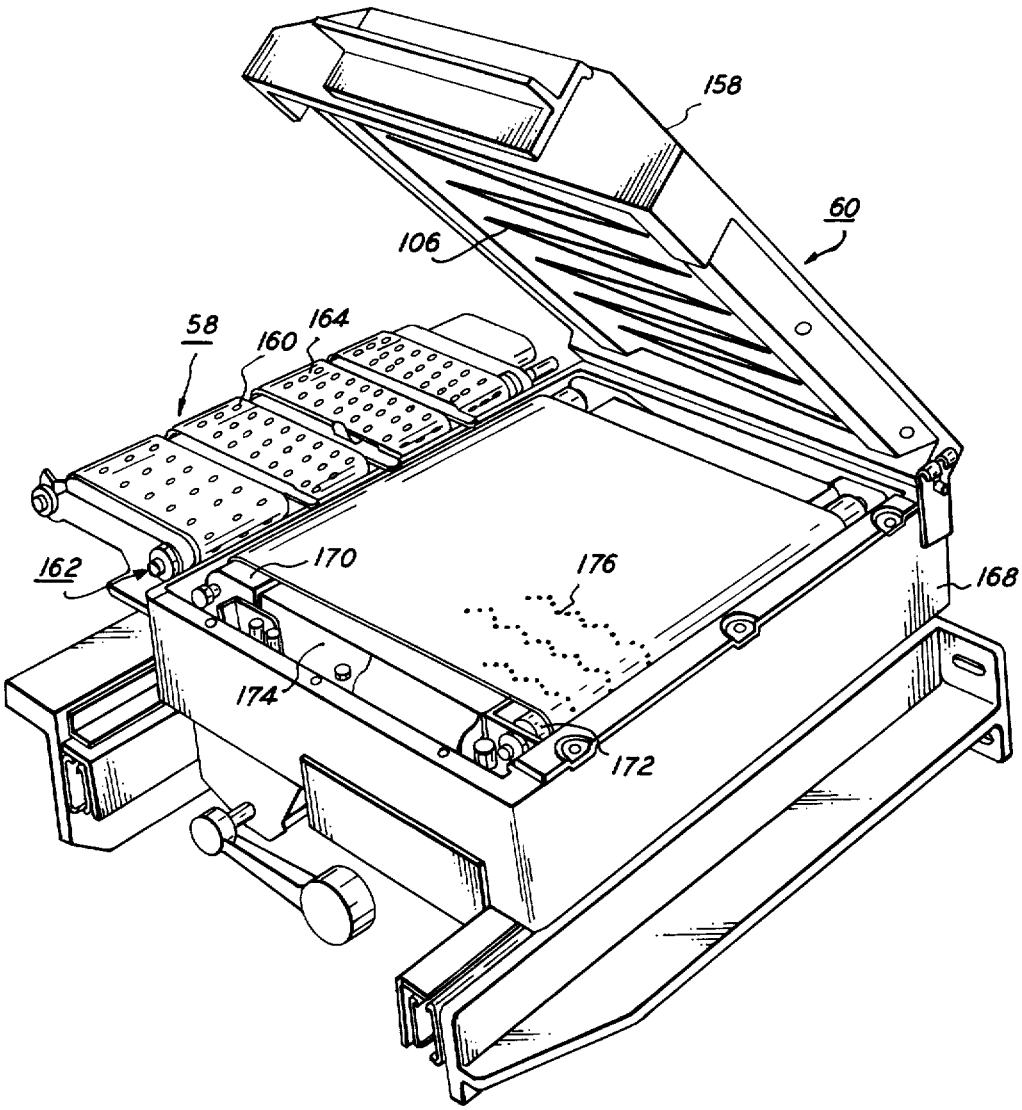
FIG. 7 is a perspective view of the FIG. 1 printing machine fuser.

Referring now to FIGS. 7 and 8, fuser 60 will be described hereinafter in greater detail. Fuser 60 is depicted in FIG. 7 as having cover member 158 pivoted to an open position. Conveyor 58 is associated with fusing apparatus 60 to transport support material 34 from transfer roll 38 thereto. Conveyor 58 includes a plurality of endless belts 116 entrained about a pair of opposed spaced rollers 162. A vacuum system maintains a low pressure by drawing air through apertures 164 of belt 160 to tack support material 34 thereto. Cover member 158 includes radiant energy source 166. Lower housing member 168 defines an open ended chamber having a pair of spaced rollers 170 and 172 mounted rotatably on a transport frame disposed therein. An endless belt 174 is entrained about rollers 170 and 172. Endless belt 174 includes a plurality of apertures 176 therein which are arranged to draw air therethrough such that support material 34 is tacked thereto as it passes through fuser 60. Preferably, cover member 158 includes a sheet metal shell having secured to the interior surface thereof suitable insulation. A nylon fiber coating is sprayed on the exterior surface of cover member 158 to protect the operator. An outer reflector is suitably attached to the interior insulation on the metal shell. An inner reflector is mounted on the outer reflector. As mounted, the inner and outer reflectors are spaced from one another permitting air to circulate therebetween. A thermistor is positioned in the air space between the inner and outer reflectors to measure the temperature thereat.

Radiant energy source 166 is preferably a radiant heat strip made from a nickel chromium alloy ribbon and entrained helically about a pair of opposed spaced support members, such as ceramic spools. Heat strip 166 provides substantially uniform radiation. A suitable guide, preferably quartz woven string, is over heat strips 166 and adapted to prevent support material 34 from contacting it.

Turning now to FIG. 8 there is shown a sectional view of lower housing assembly 168. Lower housing 168 includes a sheet metal shell having insulation secured to the interior surface thereof. The transport frame is mounted movably in the shell. Rollers 170 and 172 are mounted rotatably on the frame and have entrained thereabout endless belt 174. Interior surface **174*b* of endless belt 174 is adapted to be closely adjacent to plate member 178. Plate member 178 is heated by air moving in the direction of arrow 180. Lower member 182 has a vaned member 184 mounted thereon to create air flow in the direction of arrow 180. The air flow passes over heating means or auxiliary heater 186 onto plate member 178 raising the temperature thereof. Plate member 178 is closely adjacent to undersurface 174*b* of endless belt 174 and transmits heat thereto. This, in turn, raises the temperature of support material 34 minimizing any heat loss therefrom. In this manner, radiant energy from heat strips 166, in conjunction with auxiliary heater 186, fuse the toner powder image formed on support material 34. Fuser 60** is described in greater detail in co-pending application Ser. No. 300,531 filed in 1972, the disclosure of which is hereby incorporated into the present application.

Figure 9:
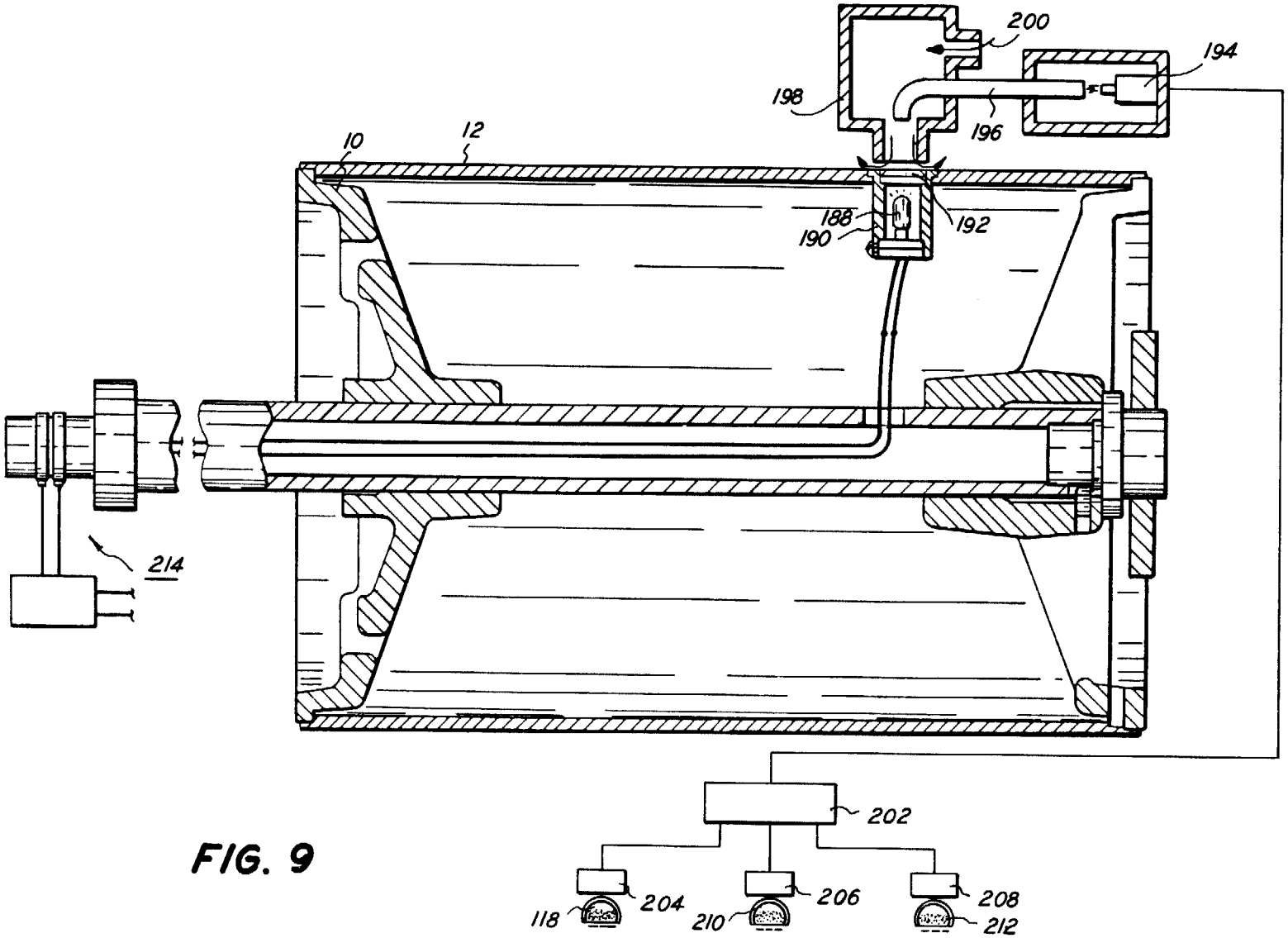
FIG. 9 is a sectional elevational view of the FIG. 1 photoconductive drum and the regulating system controlling the toner particle concentration within the developer mix.

Turning now to FIG. 9, there is shown the detailed configuration of the apparatus for controlling the concentration of toner particles within each of the developer mixes of the respective developer units 28, 30 and 32. As depicted therein, the regulating apparatus includes light source 188 which is mounted on drum 10 via housing 190. Transparent electrode 192 is disposed in an aperture on drum surface 10 with light source 188 therebeneath. Transparent electrode 192 may be biased from about 100 volts to about 600 volts above the electrical bias of the corresponding developer roll. The intensity of the light rays transmitted through electrode 192 is detected by photosensor 194. The light rays transmitted through transparent electrode 192 are transmitted by fiber optic light pipe 196 to photosensor 194. Fiber optic light pipe 196 is mounted in chamber 198 which has air flow moving in the direction of arrow 200. This insures that the surface of the fiber optic light pipe opposed from transparent electrode 192 remains substantially free of particle contamination. Transparent electrode 192 undergoes the same cleaning process as photoconductive surface 12. The output signal from photosensor 194 is processed by logic circuitry and, depending upon the density of the toner particles deposited on electrode 192, toner particles may or may not be added to the respective developer unit. Logic circuitry 202 energizes the appropriate oscillator motor 204, 206 or 208 associated with the corresponding toner particle cartridge 118, 210 and 212. Toner cartridge 210 and 212 being associated with developer units 30 and 32, respectively. The logic circuitry is adapted to compare the detection photosensor signal with a reference signal and generate an error signal proportional thereto which excites the appropriate toner particle cartridge. Essentially three duplicate logic channels are provided to regulate each of the oscillator motors 204, 206 and 208. Logic circuitry 202 is described in co-pending application Ser. No. 315,741 filed in 1973, the disclosure of which is hereby incorporated into the present application. In addition, the disclosure of the regulating system is described in U.S. Pat. No. 3,778,146 issued to Knapp in 1973 and U.S. Pat No. 3,754,821 issued to Whited in 1973, the relevant portions of which being hereby incorporated into the present application. Transparent electrode 192 is preferably an electrically conductive glass made by Pittsburgh Plate Glass under the trademark NESA. The application of the bias voltage to electrode 192 is controlled by slip ring assembly 214 which is segmented approximately 60°. In this way, no voltage is applied to transparent electrode 192 over an arc extending from about fiber optic light pipe 196 to corona generating device 16. Hence, the bias voltage is removed from transparent electrode 192 during the cleaning process.

Figure 10:
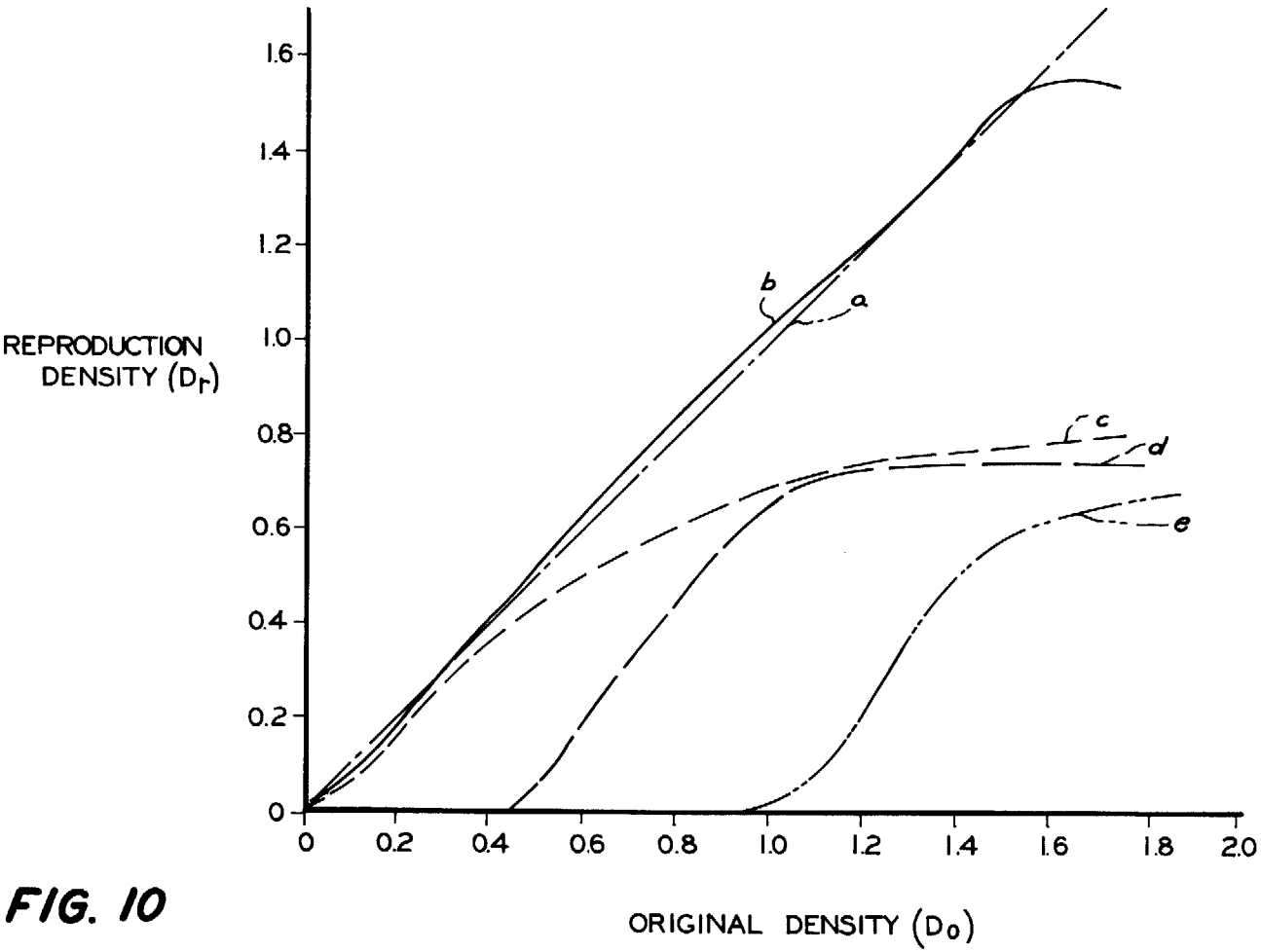
FIG. 10 is a graphical illustration of a series of curves of reproduced image density versus original image density.

Operation of the present invention is best understood by referring to the graph shown in FIG. 10. In this graph, $D_o$ represents the density of the original image given in density units from 0 to 2. $D_r$ represents the density of the reproduced image in reflection density units, where $D = \log 1/R$, $R$ being the reflectivity of the surface. Curve a of the graph depicts an ideal reproduction while curve *b* illustrates the actual reproduction curve of the system. Curves *c*, *d* and *e* show the reproduction densities achieved by each of the developer units independent of one another. Curve *c* is the reproduction curve achieved by developer unit 28, curve *d* being the reproduction curve achieved by developer unit 30, and curve *e* being the reproduction curve achieved by developer unit 32. As is shown by curve *a*, ideally the density of the reproduction ($D_r$) should correspond on a 1:1 basis with the density of the original ($D_o$) over the entire density range of the original ($D_o$). Curve *b*, which represents the capabilities of the printing machine depicted in FIG. 1, closely approximates the ideal curve.

Each of the curves *c*, *d*, and *e*, may be readily modified by adjustments in any or all of the three simple variables, exposure level, electrode bias, and toner particle concentration. Such modifications are made in order to "idealize" composite curve *b*. For example, increasing image exposure level shifts a given characteristic curve to the right; increasing electrical bias on the developer roll shifts the curve downward; and, finally, increasing toner concentration results in a rotation of the curve in a counterclockwise direction, i.e. a proportional increase in the reproduction densities.

While the present invention has been described in connection with the process of black and white electrophotographic printing, one skilled in the art will appreciate that the invention is not necessarily so limited. By way of example, each developer unit may contain discretely colored toner particles, i.e. yellow, magenta and cyan. These developer units would then have separate compartments containing differing concentrations of toner particles therein. Furthermore, the optical system would employ blue, green and yellow filters associated with each of the neutral density filters. In this manner, three successive toner powder images would be formed for each color. The resultant nine toner powder images would be transferred to the sheet of support material in superimposed registration with one another. This would result in a high fidelity color copy.

In recapitulation, the combination of controlling the magnitude of light images created from a common original document, and the development of the resultant electrostatic latent images produced thereby with developer mixes having differing toner particle concentration with different electrical biases during development results in a copy closely approximating the original document.

It is therefore apparent that there has been provided, in accordance with this invention, an electrophotographic printing machine which reproduces continuous tone original documents to produce high quality copies. The electrophotographic printing machine hereinbefore described fully satisfies the objects, aims and advantages set forth above. While this invention has been described in conjunction with specific embodiments and methods of use thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An electrophotographic printing machine, including:

a photoconductive member;

means for charging said photoconductive member to a substantially uniform level;

means for exposing said charged photoconductive member to a light image recording an electrostatic latent image thereon, said exposing means forming successive light images of differing predetermined intensities from the same original document;

means for developing the successive electrostatic latent images recorded on said photoconductive member by contacting the latent images with a developer mix of carrier granules and toner particles, said developing means comprising a plurality of developer units comprising developer mixes having the same color toner particles with concentrations thereof being different in each developer unit;

means for electrically biasing each developer unit of said developer means to differing preselected levels;

means for regulating the toner particle concentration within the developer mix of each developer unit of said developer means to differing preselected levels; and means for transferring successive developed images from said photoconductive member to a sheet of support material in superimposed registration with one another to form a mono-color copy of the original document being reproduced.

2. A printing machine as recited in claim 1, wherein said charging means includes:

an elongated shield defining an open ended chamber;

a pair of spaced, substantially parallel conductive coronode wires mounted in said shield, said pair of coronode wires extending substantially in a longitudinal direction along the length of said shield; and a plurality of spaced, substantially parallel grid wires mounted in said shield and extending substantially in a longitudinal direction along the length thereof, said plurality of grid wires partially enclosing the open end of said shield with one of said coronode wires being disposed in the chamber therebeneath and the other of said coronode wires being disposed in the unenclosed portion of the chamber of said shield.

3. A printing machine as recited in claim 2 wherein said charging means further includes:

a wiper member positioned within said shield contacting said pair of coronode wires and the interior surface of said grid wires opposed from said pair of coronode wires; and means for moving said wiper member in substantially a longitudinal direction along the length of said coronode wires and said grid wires.

4. A printing machine as recited in claim 1, wherein said exposing means includes:

a light source arranged to illuminate an original document disposed in the printing machine;

lens means for receiving the light rays from the original document to form a light thereof; and a plurality of neutral density filters having differing predetermined magnitudes, each of said neutral density filters being successively interposed between said lens means and said photoconductive member to filter the light image.

5. A printing machine as recited in claim 4, wherein said plurality of neutral density filters include:

a 0.95 neutral density filter;

a 0.55 neutral density filter; and a 0.20 neutral density filter.

6. A printing machine as recited in claim 1, wherein each developer unit of said developing means includes:

a developer housing defining a chamber storing a developer mix comprising carrier granules and toner particles therein;

conveyor means mounted for movement within the chamber of said developer housing and arranged to move the developer mix from a first region to an intermediate region;

rotary driven transport means mounted within the chamber of each of said developer housing and arranged to move the developer mix from the intermediate region to a second region for discharge thereat;

rotary driven developer means mounted within the chamber of said developer housing closely proximate to said transport means for receiving the developer mix therefrom and arranged to contact the electrostatic latent image therewith; and means for driving said conveyor means such that the reaction torque to the driving moment applied to said conveyor means pivots said developer housing disposing said developer means adjacent to the electrostatic latent image recorded on said photoconductive member.

7. A printing machine as recited in claim 6, wherein:

said transport means includes a first tubular member of non-magnetic material, said first magnetic means being fixably disposed in said tubular member for creating a magnetic field in the path of the periphery of said first tubular member; and said developer means includes a second tubular member of non-magnetic material, said second magnetic means being fixedly disposed within said second tubular member for creating a magnetic field in the path of the periphery of said second tubular member.

8. A printing machine as recited in claim 6, wherein said electrical biasing means biases the first of said developer means to preferably about 225 volts, a second of said developer means to preferably about 300 volts, and a third of said developer means to preferably 425 volts.

9. A printing machine as recited in claim 1, wherein said transferring means includes:

corona generating means disposed adjacent to said photoconductive member and adapted to apply an alternating charge potential to said photoconductive member preconditioning the toner particles thereon to readily facilitate the transfer therefrom;

a transfer member operatively associated with said corona generating means and having the sheet of support material secured releasably thereto; and means for electrically biasing said transfer member to a potential of sufficient magnitude and polarity to attract the preconditioned toner particles from the electrostatic latent image recorded on said photoconductive member to the sheet of support material secured thereto.

10. A printing machine as recited in claim 9 wherein said corona generating means includes:

an elongated shield defining an open ended chamber; and a corona discharge electrode mounted in the chamber of said shield and arranged therein to generate ions for charging the toner particles deposited on the electrostatic latent image recorded on said photoconductive member.

11. A printing machine as recited in claim 10, wherein said transfer member includes:

a cylindrical core of electrically conductive material;

a first layer of resilient material entrained about said cylindrical core and being substantially in contact therewith; and a second layer of resilient material entrained about said first layer of resilient material and being substantially in contact therewith.

12. A printing machine as recited in claim 1, further including means for affixing substantially permanently the transferred toner powder images to the sheet of support material.

13. A printing machine as recited in claim 12, wherein said fixing means includes:

means for transporting the sheet of support material with the toner powder images deposited on one surface thereof along a path of movement, said transporting means being arranged to be in substantial contact with the other surface of the sheet of support material;

means for heating said transporting means; and a radiant energy source arranged to be in thermal communication with a sheet of support material for supplying the energy output thereof onto the support material being moved with the toner powder image thereon by said transporting means along the path of movement for affixing substantially permanently the toner powder images to the sheet of support material.

14. A printing machine as recited in claim 13, wherein said transporting means includes:

a lower housing member defining an interior open-ended chamber;

a frame member mounted removably in the chamber of said lower housing member;

a plurality of rollers mounted rotatably on said frame member, said rollers being positioned spaced from one another and having the axes of rotation thereof substantially parallel to one another;

an endless belt member having a plurality of apertures therein, said belt member being entrained about said rollers; and means for removing air from the chamber of said lower housing to secure releasably the sheet of support material to the surface of said belt member.

15. A printing machine as recited in claim 14, wherein said heating means includes:

a plate member mounted in the open end of the chamber of said lower housing member interposed between said rollers and substantially contacting the interior surface of said belt member; and at least one resistant heating element disposed in the chamber of said lower housing member, said heating element being positioned in the path of movement of the air being removed from the chamber heating the air which heats said belt member.

16. A printing machine as recited in claim 1, wherein said regulating means includes:

transparent electrode means electrically biased to attract toner particles thereto as said electrode means passes through the developer mixes;

means for illuminating said electrode means having toner particles deposited thereon with light rays; and means for sensing the intensity of light rays transmitted through said electrode means to produce an electrical output signal indicative of the density of toner particles deposited thereon.

17. A printing machine as recited in claim 16, further including:

means for comparing the electrical output signal with a reference level to produce a control signal corresponding to the deviation between the actual density of toner particles deposited on said electrode means and the desired density thereof; and means, actuated by the control signal, for dispensing the selected toner particles into the developer mixes of said developing means.

18. A printing machine as recited in claim 17, further including logic means for actuating the appropriate comparing means corresponding to the toner particles undergoing development.

19. A printing machine as recited in claim 16, wherein said illuminating means includes:

a light source; and means for directing light rays from said light source through said electrode means having toner particles deposited thereon.

20. A printing machine as recited in claim 16, wherein said sensing means includes a photosensor positioned in a light receiving relationship with said directing means to receive the light rays passing through the toner particles deposited on said electrode means.

21. A printing machine as recited in claim 20, further including means, associated with said electrode means, for cyclically alternating the electrical charge on said electrode to attract toner particles thereto during the development thereof and to repel toner particles therefrom after the intensity of the light rays transmitted through said electrode means has been detected by said sensing means.

22. A printing machine as recited in claim 1, wherein said regulating means controls the first of the developer mixes such that the toner particle concentration therein is preferably about 1.95% said regulating means controls a second of the developer mixes such that the toner particle concentration therein in preferably about 2.22% and said regulating means controls a third of the developer mixes such that the toner particle concentration therein is preferably about 2.59%.

* * * * *